United States Patent [19]

Barenburg

[11] Patent Number: 5,076,310

[45] **Date of Patent: * Dec. 31, 1991**

[54] FRAMED WALL WITH A PREFABRICATED UNDERFLOOR DRAIN LINE AND METHOD OF MANUFACTURE

[76] Inventor: Alexander Barenburg, 1305 W. Wolfram St., Chicago, Ill. 60657

[ * ] Notice: The portion of the term of this patent subsequent to Apr. 24, 2007 has been disclaimed.

[21] Appl. No.: 512,357

[22] Filed: Apr. 23, 1990

Related U.S. Application Data

[63] Continuation-in-part of Ser. No. 314,155, Feb. 23, 1989, Pat. No. 4,919,164.

[51] Int. Cl.[5] ..... F16L 5/00; E04H 1/00

[52] U.S. Cl. ..... 137/15; 137/360; 52/79.1; 52/221

[58] Field of Search ..... 137/15, 360, 377; 4/211; 52/79.1, 221; 285/45

[56] References Cited

U.S. PATENT DOCUMENTS

| | | | |
|---|---|---|---|
| 2,037,895 | 4/1936 | Gugler | 72/1 |
| 2,653,357 | 9/1953 | Sanders et al. | 20/4 |
| 2,993,084 | 7/1961 | Curtiss | 174/81 |
| 3,694,973 | 10/1972 | Unger | 52/34 |
| 3,766,574 | 10/1973 | Smid, Jr. | 4/191 |
| 3,774,631 | 11/1973 | Willkins | 137/357 |
| 3,978,529 | 9/1976 | Krafft | 4/2 |
| 4,118,854 | 10/1978 | Krafft | 29/428 |
| 4,221,441 | 9/1980 | Bain | 312/228 |
| 4,513,545 | 4/1985 | Hopkins, Jr. | 52/79.1 |
| 4,799,716 | 1/1989 | Kujawa et al. | 285/334.2 |

*Primary Examiner*—A. Michael Chambers
*Attorney, Agent, or Firm*—Joseph Scafetta, Jr.

[57] ABSTRACT

A method of manufacturing a prefabricated framed wall to be mounted in a floor of a building structure under construction has several steps: cutting at least one hole through all but one of a plurality of frame studs, a top frame plate, and a bottom frame plate; aligning the plurality of frame studs; securing tops of the frame studs to the top frame plate; securing bottoms of the frame studs to the bottom frame plate; installing plumbing and other pipes between the frame studs; and inserting at least one sanitary tee through the hole in the bottom frame plate so that it depends therebelow. The one sanitary tee connects below the floor to either a bathtub or a shower. An underfloor drain line is connected to at least one fixture, such as a bathtub/shower, a toilet and a lavatory. This underfloor drain line may be inserted either below the bottom frame plate outside the framed wall or near to but below the top frame plate inside the framed wall. Removable protective boxes or blocks are secured to an underside of the bottom frame plate so that the framed wall is ready to be shipped without damage. Both embodiments of the framed wall made by the method include: a plurality of frame studs having at least one hole cut through all but one stud thereof; a top frame plate; a bottom frame plate having at least one hole cut therethrough; plumbing and other pipes installed between the frame studs; and underfloor drain line; and at least one sanitary tee inserted through the hole in the bottom frame plate for connection therebelow.

12 Claims, 5 Drawing Sheets

FRAMED WALL WITH A PREFABRICATED UNDERFLOOR DRAIN LINE AND METHOD OF MANUFACTURE

CROSS-REFERENCES TO RELATED DISCLOSURES

This application is related to Disclosure Document No. 243,849 filed on Jan. 22, 1990 and is a continuation-in-part of application Ser. No. 07/314,155, now U.S. Pat. No. 4,919,164.

BACKGROUND OF THE INVENTION

1. Field of the Invention

This invention is a development in the field of buildings generally and, in particular, relates to a framed wall with a prefabricated underfloor drain line and a method of manufacture.

2. Description of the Related Art

Prefabricated wall frameworks and containerized rooms are being used with increasing frequency in the construction of family residences and other buildings. These prefabricated and containerized units are characterized by their flush bases which make the units easy to ship by flatbed trucks and to store on job sites. As units have become larger, rough plumbing has been added directly into the prefabricated wall frameworks and the containerized rooms. As examples thereof, see the teachings in the following prior art references: U.S. Pat. No. 2,037,895 issued Apr. 21, 1936, to Gugler; U.S. Pat. No. 2,653,357 issued Sept. 29, 1953, to Sanders et al.; U.S. Pat. No. 3,694,973 issued Oct. 3, 1972, to Unger; U.S. Pat. No. 3,766,574 issued Oct. 23, 1973, to Smid, Jr.; U.S. Pat. No. 3,774,631 issued Nov. 27, 1973, to Willkins; U.S. Pat. No. 3,978,529 issued Sept. 7, 1976, to Krafft; U.S. Pat. No. 4,118,854 issued Oct. 10, 1978, also to Krafft; U.S. Pat. No. 4,221,441 issued Sept. 9, 1980, to Bain; and U.S. Pat. No. 4,513,545 issued Apr. 30, 1985, to Hopkins, Jr.

The purposes of such prefabricated and containerized units are generally stated to include increasing the speed of on-site construction and decreasing the need for skilled plumbers on the job.

However, because the plumbing in these units usually does not extend below the flush bases of such units, holes must be cut or drilled, often by unskilled laborers, into these bases in order to allow for the connection of such plumbing pipes either below the floor or into a wall framework on a lower level. Unfortunately, such unskilled laborers sometimes make mistakes, thus ruining not only the base or the bottom board, but occasionally the entire unit. Such errors are costly and cause construction delays in procuring replacement units. Nevertheless, there is still no known solution for preventing such mistakes.

Furthermore, constant research by developers, contractors, and others in the housing industry has not yet made any substantial improvement, other than the inclusion of rough plumbing, in prefabricated wall frameworks and containerized rooms during the 1980's.

SUMMARY OF THE INVENTION

A framed wall includes, in addition to rough plumbing, electrical conduits, and ducts for heating and cooling the building being constructed. The framed wall made by the installation method has its rough plumbing pipes, its electrical conduits, its heating/cooling ducts, and any other type of connections extending below its bottom frame plate so that unskilled or semiskilled laborers can quickly and easily connect such pipes, conduits, and ducts either below the floor or directly into the framed wallwork on the lower level without the need for cutting the base or the bottom frame plate.

It is a primary object of the present invention to provide a framed wall which is a substantial improvement over the prior art arrangements by prefabricating underfloor drain lines, electrical conduits, heating/cooling ducts, and other types of connections, in addition to rough plumbing pipes, directly into such a framed wall. Such other types of connections include, but are not limited to, vacuum lines, telephone wires, intercom circuits, and the like.

It is a secondary object of the present invention to provide a more sophisticated and intricate framed wall which will reduce the high labor costs of skilled electricians and installers of heating/cooling systems, yet which is capable of being connected to upper and lower level wallworks by less expensive unskilled and semiskilled laborers.

It is a tertiary object of the present invention to prevent the ruination of entire prefabricated wallworks caused by errors made by unskilled employees when cutting either the top or the bottom frame plate of such prefabricated wallworks by providing framed walls that already have plumbing pipes, electrical conduits, and heating/cooling ducts extending through the bottom frame plate, thus obviating the need for such cutting steps by unskilled laborers.

It is another object of the present invention to increase the efficiency and the speed at which residences and other buildings are constructed on job sites.

It is a further object of the present invention to provide a method and a means for shipping prefabricated wall frameworks and containerized rooms with underfloor drain lines, pipes, conduits, and ducts extending through the top or the bottom frame plate thereof without causing damage to such wall and room units.

It is a still further object of the present invention to provide a framed wall that may be incorporated into a variety of floor plans, thus permitting flexibility in design choices for multistory buildings.

These and other objects of the present invention will become readily apparent from the following brief description of the drawings and the subsequent detailed description of the preferred embodiments.

DETAILED DESCRIPTION OF THE PREFERRED EMBODIMENT

Figure 1:
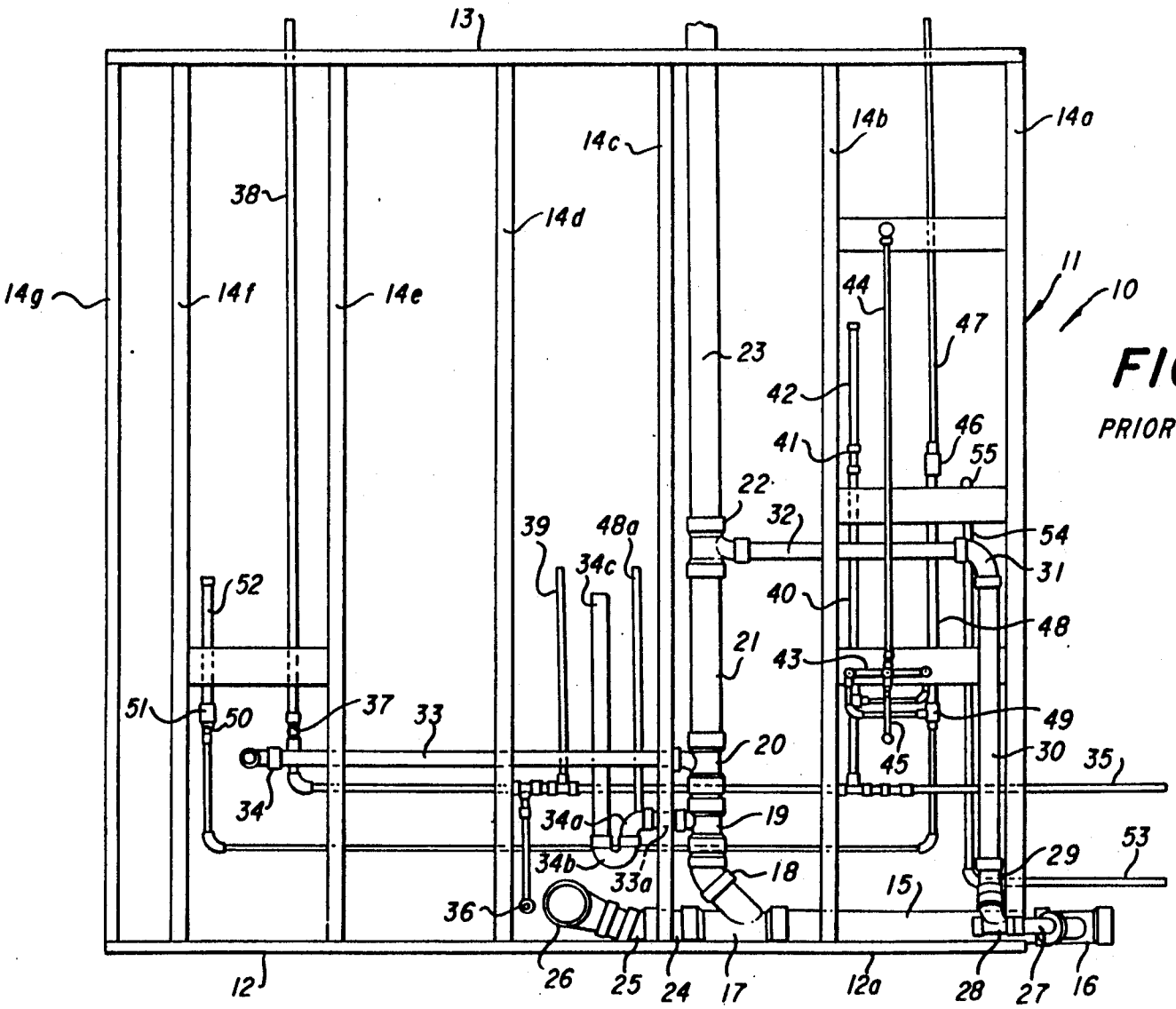
FIG. 1 PRIOR ART
FIG. 1 is a front elevational view of a prefabricated framed wall known in the prior art and incorporating rough plumbing therein.

Referring first in detail to a known prior art arrangement of one Willkins mentioned above, FIG. 1 shows generally a prefabricated modular rough plumbing unit 10 for back-to-back plumbing installation directly upon a building slab during framing of the building. The plumbing unit 10 comprises a wall framework 11, preferably of 2×6 lumber, including a bottom plate 12, a top plate 13 and vertical studs 14*a* through 14*f*. The studs 14*a* through 14*f*, which include between them all the necessary rough plumbing, are spaced 16 inches on centers, in accordance with usual building code requirements. If the full length of the wall required in the building in which the plumbing unit 10 is installed is only slightly longer than the length afforded by the six studs 14*a* through 14*f*, such full length is provided for by extending the lengths of the bottom 12 and top 13 by the required amount and by adding an additional end stud 14*g*. The overall height of the plumbing unit 10 is the full height of the partition required in the building under construction. It is understood, however, that the wall framework 11 could be shortened to the extent permitted by the interior plumbing to facilitate storage and transportation of the modular units. In such instances, it is necessary for the carpenter, upon installation of the rough plumbing unit, to continue the stud work to the required room height.

The modular unit 10 is designed for back-to-back plumbing installation accommodating a bathroom tub, shower water closet, and a lavatory at one side of the wall. Either a kitchen sink and a water heater or a clothes washer and a water heater may be accomodated at the other side of the wall.

As illustrated in FIG. 1, the modular unit 10 of the prior art comprises a short length of soil pipe 15 resting upon the bottom plate 12 at one end thereof and extending through openings at the lower ends of the vertical studs 14*a* and 14*b*. One end of the soil pipe or bottom drain line 15 extends through the outer stud 14*a* where it is joined to a 45° Y-branch 16 extending in the horizontal direction. The inner end of the drain line 15 is joined to a 45° Y-branch 17, the branch arm of which is directed upwardly. The upper end of the Y-branch 17 is joined to a 45° elbow or bend 18 extending upwardly between the wall framework studs 14*b* and 14*c*. The elbow 18 connects in vertical succession with a first sanitary tee 19, a second sanitary tee 20, a short length of vent stack pipe 21, a third sanitary tee 22, and a long length of vent stack pipe 23, thus continuing the ventilation through an opening in the top plate 13. The inward, horizontally extending portion of the 45° Y-branch 17 connects with a short length of horizontal soil pipe 24 terminating in a 1/16-inch bend 25. The outer end of the bend 25 is connected with a closet bend 26 extending horizontally outward at one side of the wall framework 11 in a vertically spaced relationship above the bottom plate 12.

The branch portion of the 45° Y-branch 16, which extends horizontally outwardly of the same side of the wall framework 11 as the closet bend 26, joins with a horizontally disposed ⅛-inch bend 27. The outer end of the ⅛-inch bend 27 is joined with a sanitary tee 28. The branch portion of the sanitary tee 28 extends upwardly and inwardly at an angle of approximately 45° with respect to the vertical wall framework 11. The outer end of the branch portion of the sanitary tee 28 joins with a vertically and upwardly extending ⅛-inch bend 29 between the wall framework studs 14*a* and 14*b*. The ⅛-inch bend 29 connects with a vertical vent pipe 30 terminating in a 90° bend or elbow 31 directed inwardly towards the vent stack pipe 23 and joined therewith through a horizontal vent pipe 32 connected with the branch portion of the third sanitary tee 22.

A slightly pitched, substantially horizontal waste pipe 33, extending through openings in the vertical studs 14*c*, 14*d*, and 14*e*, is joined at one end with the waste branch portion of the second sanitary tee 20 and connects at its outer end with a 90° bend 34 extending outwardly of the wall framework 11 at the same side as the closet bend 26.

A short length of horizontally extending waste pipe 33*a* extending through the wall framework stud 14*c* connects at one end with the waste branch portion of the second sanitary tee 19 and connects at its outer end with a downwardly directed elbow 34*a*. The outer end of the elbow 34*a* joins with a U-bend 34*b* which, together with the elbow 34*a*, provides a trap for a vertical length of drain pipe 34*c* to accommodate a washing machine installation at that side of the wall framework 11 opposite the closet bend 26. Alternatively, the drain pipe 34*c* is used as a waste connection for a kitchen sink.

The drain and waste piping described above is preferably assembled with use of synthetic plastic components, such as polyvinyl chloride, otherwise known as PVC, because of its sturdy construction and its lightness in weight. It is to be noted, however, that copper pipe or other piping is used wherever required or preferred.

In the assembly of the above-described prior art piping, it is understood that the bottom drain line 15 is slightly pitched in such a direction so as to insure drainage into the 45° Y-branch 16. The sanitary tee 28 is directed sidewardly and outwardly of the wall framework 11 as a waste connection for a bathtub. It is, therefore, kept as low as possible to permit installation of any ordinary bathtub at slab level. To this end, the bottom plate 12 is preferably in the form of a thin, bent metal channel plate having upstanding sidewall portions 12*a* and 12*b* upon which such piping can rest and be secured in place by the wall framework studs 14*a*, 14*b* and 14*c*.

The piping, including the vent pipes 30 and 32 connecting the sanitary tee 28 with the vent stack pipe 23, provide back venting for the bathtub upon its installation in accordance with plumbing code requirements, thus insuring free bathtub drainage. That portion of the above-described waste system extending outwardly of the first end stud 14*a*, more particularly the 45° Y-branch 16 and a portion of its associated ⅛-inch bend 27, is adapted to extend through an outside wall of the building in which the modular unit 10 is installed. Thus, upon installation, a suitable side wall opening is provided for the 45° Y-branch 16 for connection to an outside cleanout fitting and/or the sewer line. Thus, in installation, the outer vertical stud 14*a* of the wall framework 11 is adapted to be secured against an inside wall portion in the building under construction in the same manner as one would secure in place wall studding in ordinary house construction. It is thus understood that the carpenter, during the interior framing of the house, will be able to install the modular unit 10 in place in accordance with the plans without the aid of an on-the-job plumber.

In addition to the above-described waste piping, the modular unit 10 also includes within its framework hot and cold water supply piping stubbed out for subsequent connection with plumbing fixtures, a hot water heater, etc. To this end, a cold water supply pipe 35 extends horizontally through framework studs 14*a*, 14*b*, 14*c*, 14*d* and 14*e* for connection with a sidewardly and outwardly extending water closet stub pipe 36, a cold water bathroom lavatory stub 37, and a vertical cold water line or riser 38 for use in multi-story construction. The cold water supply pipe 35 also connects with a utility cold water stub-out pipe 39 for supplying water to either a clothes washer or a kitchen sink, for example, and with a vertical cold water pipe 40 having a fitting 41 at its upper end extending into an antiwater-hammer air chamber 42. The fitting 41 has a tee (not shown) that joins with a sidewardly and outwardly extending cold water stub (not illustrated) for supplying water to a hot water heater on the other side of the wall framework 11. The vertical cold water pipe 40 also connects with the cold water side of a diverter 43 connecting with a shower riser 44 and a tub faucet stub 45. A fitting 46 located in laterally spaced relationship with respect to the fitting 41 between the vertical studs 14*a* and 14*b* is connected with an upwardly extending hot water riser 47 for use in multistory construction and in residences where a hot water connection to remote fixtures is to be made through the ceiling. The fitting 46 is stubbed out via a tee (not shown) for subsequent connection with the hot water outlet of a water heater and joins with a downwardly extending hot water pipe 48. The hot water pipe 48 connects through the fitting 49 to the hot water side of the diverter 43 and passes laterally through wall studs 14*b*, 14*c*, 14*d* and 14*e*. The hot water pipe 48 connects with utility area hot water stub-out pipe 48*a* and bathroom lavatory stub 50. The stub 50 extends sidewardly and outwardly of a T-fitting 51, the upper end of which joins with an antiwater-hammer air chamber 52. A hot water relief pipe 53 extends inwardly to a vertical pipe 54 that terminates in a sidewardly and outwardly extending stub 55. The relief pipe 53 is provided for connection with a pressure relief valve of a hot water heater upon its subsequent installation.

While cold and hot water riser pipes 38 and 47 are illustrated in FIG. 1 and described herein, it is understood that these pipes 38 and 47 are supplied only for connection with identical or similar modular plumbing units 10 aligned vertically above in multistory building construction and in residences where an overhead supply connection and/or a remote fixture connection is made through the ceiling joists.

Figure 2:
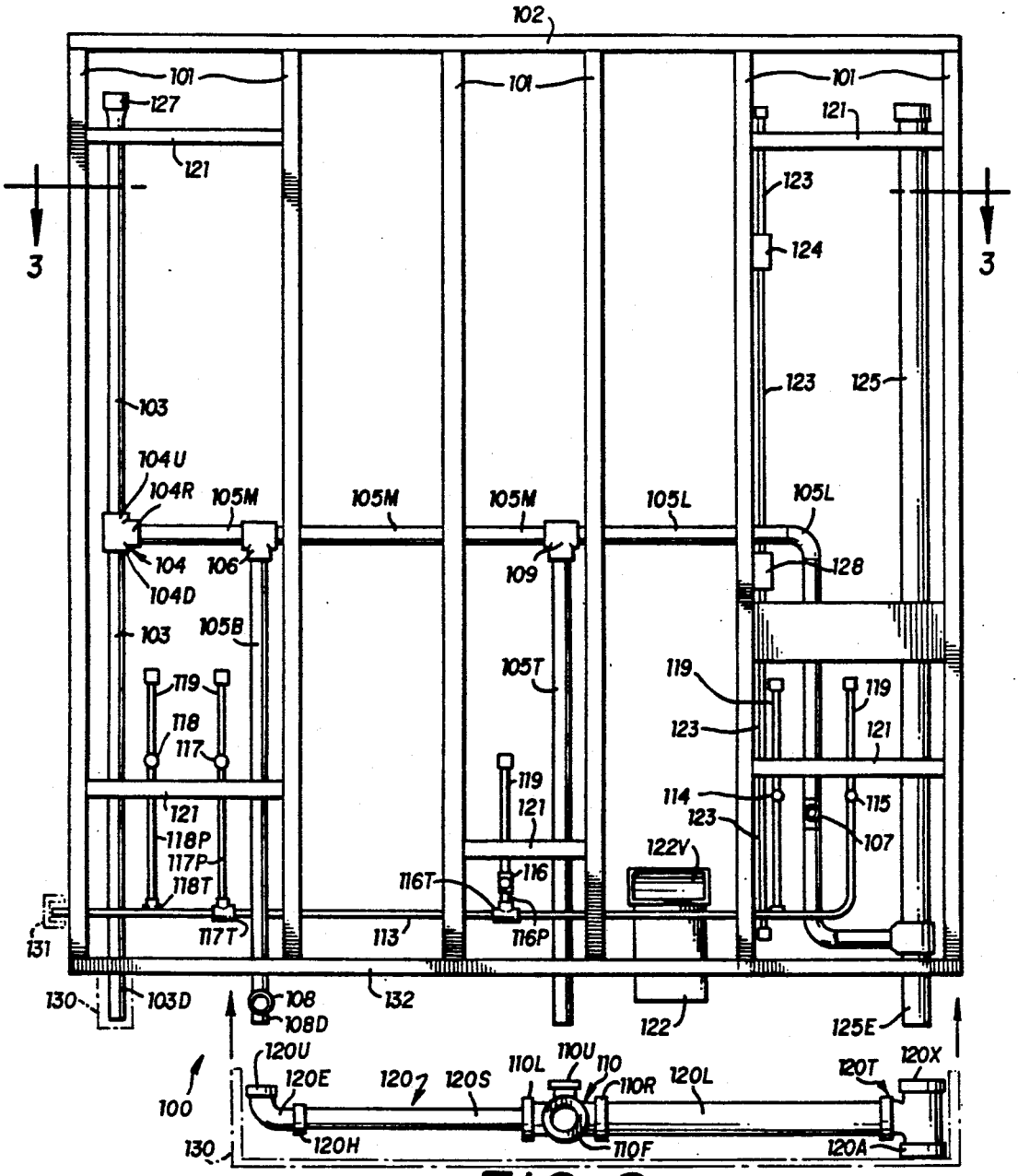
FIG. 2 is a front elevational view of a first embodiment of the present invention which is a prefabricated framed wall incorporating underfloor drain lines, plumbing pipes, electrical conduits, and heating/cooling ducts extending through the bottom frame plate.
Figure 3:
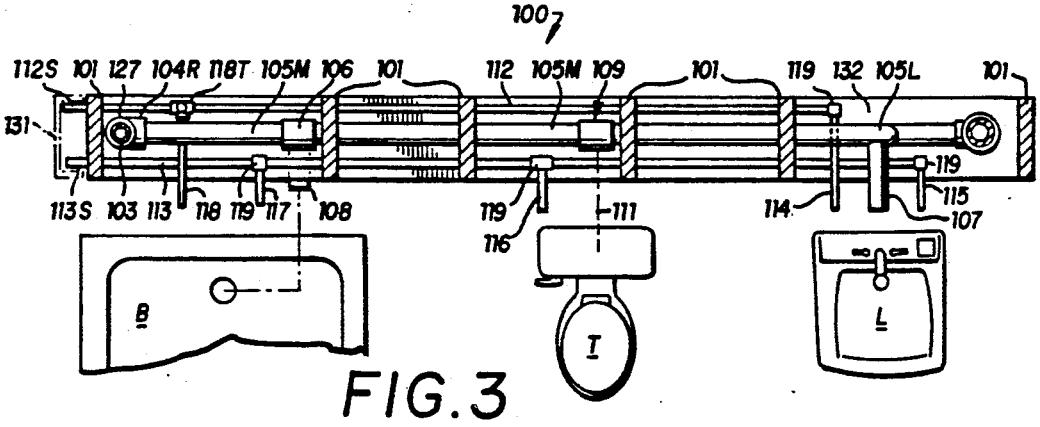
FIG. 3 is a cross-sectional view of the first embodiment taken along line 3—3 in FIG. 2.

Referring now in detail to the present invention, FIGS. 2 and 3 show generally a first embodiment constituting a framed wall section 100, preferably made of six-inch lightweight metal studs, plates or channels, including vertical frame studs 101 screwed or welded at their tops to a horizontal frame plate 102 and also screwed or welded at their bottoms to a horizontal base or bottom frame plate 132 to form a rectangular framed wall section 100 for joining to an adjacent rectangular framed wall section (not shown) in order to construct a framed wallwork, in this particular case, for a bathroom.

Within the framed wall section 100, there is a first tee-fitting 104 having a vent stack 103 extending vertically from an upper arm 104U to a coupling or collar 127 that connects to an upper floor level. The tee-fitting 104 also has a right arm 104R that receives a main vent 105M extending horizontally. A lavatory vent 105L extends upwardly and horizontally from a sanitary tee 107 for connecting the main vent 105M to a lavatory L. A second tee-fitting 106 receives a bath vent 105B that extends upwardly from a bathtub sanitary tee 108 positioned below a bathroom floor (not shown) for connection to either a bathtub B or a shower (not shown). The bath vent 105B extends through the base or bottom frame plate 132 so that the sanitary tee 108 depends therebelow. From a downwardly extending arm 104D of the first tee-fitting 104, the vent stack 103 connects vertically via a depending end 103D to a lower floor level.

A prefabricated underfloor drain line 120 has a fitting bend or elbow 120E that connects at an upper end 120U to a downwardly extending arm 108D of the bath sanitary tee 108. Instead of the elbow 120E, the drain line 120 may have a long-sweep bend or a combination Y with a ⅛-inch bend (not shown). A horizontal end 120H of the bend or elbow 120E connects to one end of a horizontally extending small drain 120S. The prefabricated underfloor drain line 120 also incorporates a sanitary tee 110 with an inlet 110U. The drain line 120 may have two fittings (not shown) substituted for the single sanitary tee 110. One of the fittings is a combination Y and a ⅛-inch bend. The other fitting is a sanitary tee with an arm for connection to the toilet vent 105T. The sanitary tee 110 has a left arm 110L connected to the horizontally extending small drain 120S. A right arm 110R is connected to a horizontally extending large drain 120L. A front arm 110F of the sanitary tee 110 receives one end of a toilet waste pipe 111 that is joined at its other end to a toilet T. To the upwardly extending inlet 110U of the sanitary tee 110, there is connected one end of a toilet vent 105T that is joined to a third tee-fitting 109. Note that the toilet vent 105T extends through the frame plate 132. The large drain 120L leads to an end sanitary tee 120T which has a depending arm 120A that directs waste down into a sewer system. The sanitary tee 120T also has an upwardly extending arm 120X that connects to a lower end 125E of a sewer pipe 125 which leads to an upper floor level.

The dependence of the bath sanitary tee 108 and the independence of the underfloor drain line 120 below the base or bottom frame plate 132 of the framed wall section 100 are key features of the present invention that, consequently, allows the framed wall section 100 to be used in standard housing construction because the framed wall section 100 is installed flush at any floor level without additional installation steps being required.

Framed wallworks used in prefabricated housing construction, such as the prior art arrangement of Willkens, have both the bath sanitary tee 108 and the toilet sanitary tee 110 arranged within the framed wall section 100 and slightly above the bottom board or lowest plate 132 so that a special raised bathtub B and toilet T must be installed. Such so-called "throne" arrangements, which require users to take at least one step up onto an elevated portion of the bathroom where the bathtub/shower and toilet T are located, are generally disliked by elderly persons, the handicapped, and families with very young children.

In order to facilitate the shipment of the framed wall section 100 of the present invention, protective boxes 130, longer than the depending end 103D and the underfloor drain line 120, are secured to the underside of the bottom frame plate 132 at the manufacturing plant where each framed wall section 100 is assembled.

After unloading the framed wall sections 100, with the protective boxes 130 depending therefrom, off the truck or trailer on which the framed wall sections 100 arrived, unskilled workers can easily knock off the depending boxes 130 with hammers when such framed wall sections 100 are ready for use on the job site. Thus, the depending end 103D of the vent stack 103 and the underfloor drain line 120 are protected from damage in transit and the bottom frame plate 132 of the framed wall section 100 need not be either cut or drilled by unskilled workers in order to connect the sanitary tees 108, 110, and 120T to the bathtub B, the toilet T, and the sewer system, respectively. Alternatively, each framed wall section 100 may be shipped upside down with the top frame plate 102 laid on the flatbed of the truck or trailer because there are no protrusions of piping and the like above the top frame plate 102. Thus, the removable protective boxes 130 are not necessary when the framed wall sections 100 are shipped upside down.

Returning to a discussion of the plumbing pipes confined within the framework of each framed wall section 100, it is best shown in FIG. 3 that a hot water line 112 and a cold water line 113 may enter through the most leftward frame stud 101 via sleeves 112S and 113S, respectively, and extend almost all the way to the most rightward frame stud 101. These sleeves 112S and 113S may be protected in transit by a protective box 131.

At preselected locations, the water lines 112 and 113 turn upwardly, as best shown in FIG. 2, and are connected to a lavatory hot water stub 114 and to a lavatory cold water stub 115, respectively. Above each stub 114 and 115, there is arranged an antiwater-hammer air chamber 119.

Referring again to the most leftward frame stud 101, when particular attention is paid to FIG. 3, it may be seen that the cold water line 113 is more forward than and, thus, blocks the view of the hot water line 112 in FIG. 2. So as to avoid confusion, reference is made first to FIG. 2, wherein a pipe tee 116T in the cold water line 113 is shown. From a visible upper branch of the pipe tee 116T, a short pipe section 116P extends to join with a cold water stub 116 for the toilet T. Above the cold water stub 116, there is another antiwater-hammer air chamber 119. Likewise, farther along the cold water line 113, shown between the most leftward and the second most leftward frame stud 101 in FIG. 2, there is another pipe tee 117T. From a visible upper branch of the pipe tee 117T, a cold water pipe section 117P extends upwardly to a cold water stub 117 for either the bathtub B or the shower (not shown). Again, above the stub 117, there is an antiwater-hammer air chamber 119.

Referring back to FIG. 3, it is seen that the hot water line 112 has a complementary bathtub/shower pipe tee 118T which is partially obscured in FIG. 2. From an upper branch of the pipe tee 118T, a hot water pipe section 118P extends to a hot water stub 118 for either the bathtub B or the shower (not shown). Above this stub 118, there is also an antiwater-hammer air chamber 119.

Cold water from the stub 117 and hot water from the stub 118 join together in a stream in a mixing faucet (not shown) in the bathtub B. Alternatively, instead of pointing towards the bathtub B, both the stub 117 and the stub 118 may point towards each other so that the cold water and the hot water join in a stream in a mixing faucet (not shown) arranged inside the framed wall section 100. From the mixing faucet, a single spigot (not shown) leads to the bathtub B.

As it may be surmized, the height of the stubs 117 and 118 above the bottom board 132 will be selected, depending upon whether either a bathtub B or a shower (not shown) is to be installed. From FIG. 2, it may also be surmized that, since the stubs 117 and 118 are only slightly above the lavatory stubs 114 and 115, this particular framed wall section 100 is intended for installation into a bathroom with a bathtub B. If a shower were intended to be installed instead of the bathtub B, the stubs 117 and 118 would be much higher in height than the height of the stubs 114 and 115 for the lavatory L. To facilitate steadiness of the stubs 114, 115, 116, 117, and 118, three cross-braces 121 support the respective antiwater-hammer air chambers 119 leading up from the stubs just enumerated. Two other cross-braces 121 support the vent stack 103 and the sewer pipe 125 near the top plate 102.

For conventional prefabricated wallworks, the discussion would end here because there are only plumbing pipes fixed into such framed wall sections 100.

However, in the present invention, as shown only in FIG. 2, there is also at least one duct 122 through which either hot air from a heater (not shown) or cold air from an air conditioner (also not shown) flows. The heater and the air conditioner may be parts of a central air circulating system that is situated in the basement. Air is pumped by the system up the duct 122 and part of such air enters the bathroom through an outlet vent 122V.

Furthermore, as also shown only in FIG. 2, the present invention includes at least one electrical conduit 123 that runs down through the cross-brace 121 along the second most rightward frame stud 101. A first junction box 124 is secured to the frame stud 101 and supplies electricity via the conduit 123 to a wall lighting fixture (not shown). A second junction box 128 is also fastened to the second most rightward frame stud 101 and supplies electricity via the conduit 123 to a wall receptacle (not shown) positioned above the lavatory L.

Now that the various parts that comprise the framed wall section 100 have been described, a detailed discussion will be made about the method of manufacturing the first embodiment of the present invention.

The method of making the framed wall section 100 to be mounted into a building structure under construction comprises several steps.

Initially, in the manufacturing plant, a worker punches preferably three holes in a number of identical metal channels. One metal channel which will serve as a rightmost frame stud 101 will have no holes punched therethrough while another metal channel which will serve as a leftmost frame stud 101 will have only two holes punched therethrough. The worker then aligns some of the punched channels as a plurality of internal frame studs 101 on a working surface, such as a floor, so that they will be oriented vertically and substantially parallel to each other when the framed wall section 100 is assembled and mounted upright into a building structure. Thereafter, the channel with no holes and the channel with two holes are added as the rightmost and the leftmost external frame studs 101, respectively. Then the tops of the plurality of aligned frame studs 101, which number six in FIGS. 2 and 3, are secured by screwing or welding them to another punched channel that serves as the top frame plate 102 which will be horizontally oriented when the framed wall section 100 is completed and turned upright. In a similar manner, the bottoms of the plurality of aligned frame studs 101 are fastened by screwing or welding them to a different punched channel that serves as the bottom frame plate 132 which will be oriented horizontally and substantially parallel to the top frame plate 102 when the framed wall section 100 is finished and turned upright. Alternatively, the bottoms of the frame studs 101 may be secured to the bottom frame plate 132 first and then the tops of the frame studs 101 may be secured to the top frame plate 102.

Next, the cross-braces 121 are added and the various plumbing pipes 103–119 are installed by workers at the manufacturing plant in any convenient manner through the holes punched in the channels that serve as the plurality of frame studs 101, the top frame plate 102, and the bottom frame plate 132. Meanwhile, the underfloor drain line 120 is fabricated separately. Thereafter, at least one duct 122 for heating and/or cooling air is installed therebetween. Likewise, at least one electrical conduit 123 is installed therebetween. Although it is preferable to install the plumbing pipes 103–119 first, followed by the heating/cooling duct 122 and finally the electrical conduit 123, the installer may actually secure the plumbing pipes 103–119, the duct 122, and the electrical conduit 123 in any convenient order.

Through one such hole cut in the bottom frame plates 132, the bathtub sanitary tee 108, best seen in FIG. 2, is inserted so that the sanitary tee 108 depends below the bottom frame plate 132. Since it can be seen that the sanitary tee 108 leads to the underfloor drain line 120, it may be surmized that this sanitary tee 108 is intended for eventual connection on a job site at a point below the bathroom floor.

Through another such hole cut in the bottom frame plate 132, the depending end 103D of the vent stack 103, best seen in FIG. 2, is also inserted so that the end 103D depends below the bottom frame plate 132. Since the end 103D leads to the lower floor level, this end 103D is also intended for eventual connection on a job site at a point below the bathroom floor.

Through the third such hole cut in the bottom frame plate 132, the duct 122 for heating and/or cooling air, best seen in FIG. 2, is inserted so that the duct 122 depends below the bottom frame plate 132. Since the duct 122 leads to the bathroom outlet vent 122V, such duct 122 is intended for eventual connection on a job site to either a heater or an air conditioner or a combined air conditioner/heater (not shown) at a point below the bathroom floor, preferably in the basement of the building under construction.

Following the insertion of the sanitary tee 108, the vent stack 103, and the duct 122 into the holes cut vertically through the bottom frame plate 132, an optional step of the method may include covering at least one side and possibly both sides of the framed wall section 100 with dry wall boards or other suitable surfacing means.

Although the framed wall section 100 has been discussed in relation to its use as a prefabricated unit in a bathroom, the framed wall section 100 may also be used in either a kitchen or a laundry room. If the framed wall section 100 is used in either a kitchen or a laundry room, then the sanitary tee 108 and the end 103D of the vent stack 103 function as waste pipe connectors in FIGS. 2 and 3. In both cases, the waste pipe connectors 108 and 103D depend below a floor in either a kitchen or a laundry room for connection to either a kitchen sink, a dishwasher, a laundry basin, a clothes washer, or a dryer (not shown).

The protective boxes 130 and 131, shown in dashed lines in FIG. 2, are secured by any suitable fastening means to an underside of the bottom frame plate 132 and to an outer side of the most leftward frame stud 101, respectively. In lieu of such boxes 130 and 131, a pair of removable blocks may be placed adjacent to each tee, stack end, and duct to be protected.

At the conclusion of this step, each framed wall section 100 is ready to be shipped without damage to either the sanitary tee 108 of the depending end 103D of the vent stack 103 or the duct 122, all of which hang below the bottom frame plate 132, because the protective boxes 130 are secured thereover so that the sanitary tee 108, the depending end 103D of the vent stack 103, and the duct 122 do not contact the flatbed of the trailer on which such framed wall sections 100 are being shipped.

If the manufacturing process does not include the final step of securing either the removable blocks or the protective boxes 130 and 131 on the underside of the bottom frame plate 132 and the most leftward frame stud 101, respectively, then the framed wall sections 100 are shipped either upside down on the top frame plate 102 or on their right sides with the most rightward frame stud 101 on the bottom, so that either the flat top frame plate 102 or the most rightward frame stud 101 contact the flatbed of the trailer. The framed wall sections 101 are never shipped on their left sides with the most leftward frame stud 101 on the bottom, because it is desired to avoid shifting of the load since the protective box 131 covering the sleeves 112S and 113S, best shown in FIG. 3, is secured only at the bottom and not also at the top of the most leftward frame stud 101.

Figure 4:
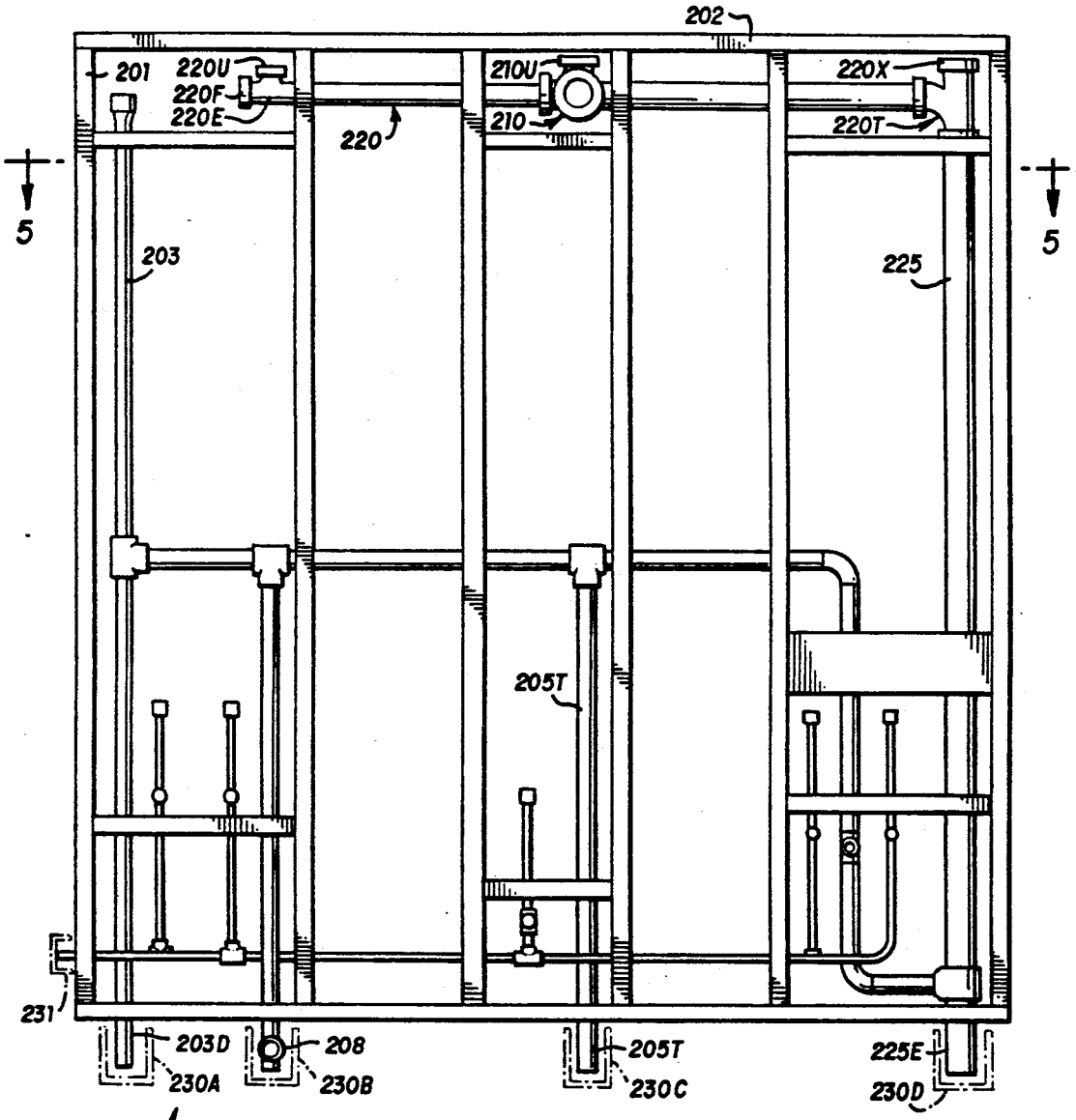
FIG. 4 is a front elevational view of a second embodiment of the present invention which is a prefabricated framed wall incorporating plumbing pipes through the bottom frame plate and underfloor drain lines for connection through the top frame plate.
Figure 5:
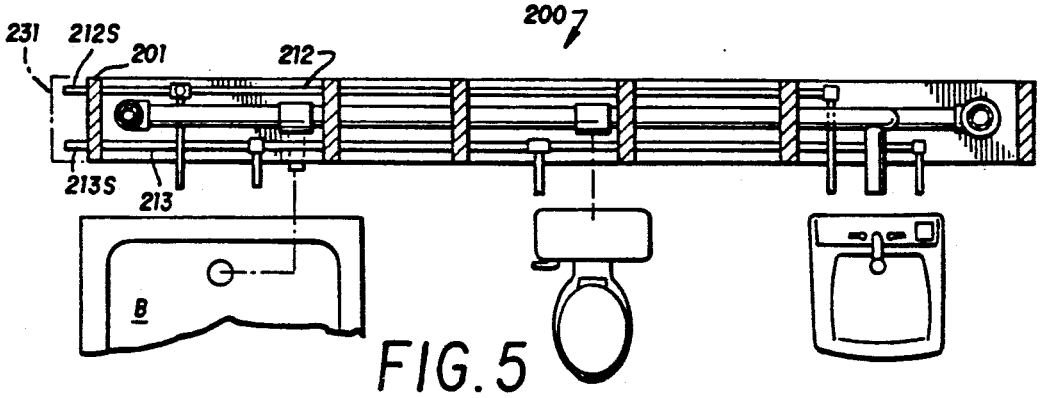
FIG. 5 is a cross-sectional view of the second embodiment taken along line 5—5 in FIG. 4.

Referring now to the second embodiment shown in FIGS. 4 and 5, elements which are identical to the elements both shown and described in regard to the first embodiment of FIGS. 2 and 3 either are left unnumbered or are identified by a 200-series of reference numerals to contrast them with the 100-series of numerals used for the first embodiment in FIGS. 2 and 3.

Also, for the sake of simplicity, elements in the second embodiment comparable to the duct 122, the vent 122V, the electrical conduit 123, the first junction box 124, and the second junction box 128 in the first embodiment have been omitted.

The primary difference between the framed wall section 100 in the first embodiment of FIGS. 2 and 3 and a framed wall section 200 in the second embodiment of FIGS. 4 and 5 is the placement of the underfloor drain line. Whereas the underfloor drain line 120 in FIGS. 2 and 3 is placed outside the frame wall section 100 and below the bottom frame plate 132, an underfloor drain line 220 in FIGS. 4 and 5 is placed inside the framed wall section 200 and below a top frame plate 202. The underfloor drain line 220 is intended for connection on an upper floor level with a bathtub sanitary tee 208, a toilet vent 205T, and a lower end 225E of a sewer pipe 225. The sanitary tee 208, the toilet vent 205T, and the lower end 225E connect, respectively, to an upper end 220U of a first sanitary tee 220E, to an upwardly extending inlet 210U of a second sanitary tee 210, and to an upwardly extending arm 220X of a third sanitary tee 220T.

The first sanitary tee 220E in this second embodiment is equivalent to the elbow 120E in the first embodiment and has a horizontally extending flange 220F for connection to a separate bathtub B or shower (not shown) on the upper floor level. As in the case of the first embodiment, the sanitary tee 220E in this second embodiment may be replaced by a long-sweep bend or a combination Y with a ⅛-inch bend (not shown). Also, as in the case of the first embodiment, two fittings (not shown) may be substituted for the sanitary tee 210 with the inlet 210U. One of the fittings is a combination Y and a ⅛-inch bend. The other fitting is a sanitary tee with an arm for connection to the toilet vent 205T on an upper level.

Since the underfloor drain line 220 shown in FIG. 4 does not need a protective element like the box 130 shown in FIG. 2 because the drain line 220 is inside the framed wall section 200 in FIG. 4 and not outside the framed wall section 100 as is the drain line 120 in FIG. 2, the single large protective box 130 shown in FIG. 2 may be replaced by a plurality of small protective boxes 230A, 230B, 230C and 230D in FIG. 4.

The box 230A protects a depending end 203D of a vent stack 203 while the box 230B protects the sanitary tee 208. Likewise, the box 230C protects a lower end of the toilet vent 205T while the box 230D protects the lower end 225E of the sewer pipe 225. As best shown in FIG. 5, an additional box 231 protects sleeves 212S and 213S protruding from the most leftward frame stud 201. The sleeve 212S is the entry point for hot water into a pipeline 212 while the sleeve 213S is the entry point for cold water into a pipeline 213.

The method of making the framed wall section 200 of the second embodiment to be mounted into a building structure under construction is substantially the same as the method of making the framed wall section 100 of the first embodiment described above, except for the placement of the underfloor drain lines 120 and 220. Accordingly, the manufacturing method for the second embodiment will not be described in detail because it is believed to be self-evident from the foregoing description of the method for making the first embodiment, when considered in conjunction with the views of the second embodiment in FIGS. 4 and 5. An essential difference between the method for manufacturing the first embodiment and the method for manufacturing the second embodiment is that the underfloor drain line 220 is assembled into the framed wall section 200 with the plumbing pipes and not separately outside of the framed wall section 200.

Figure 6:
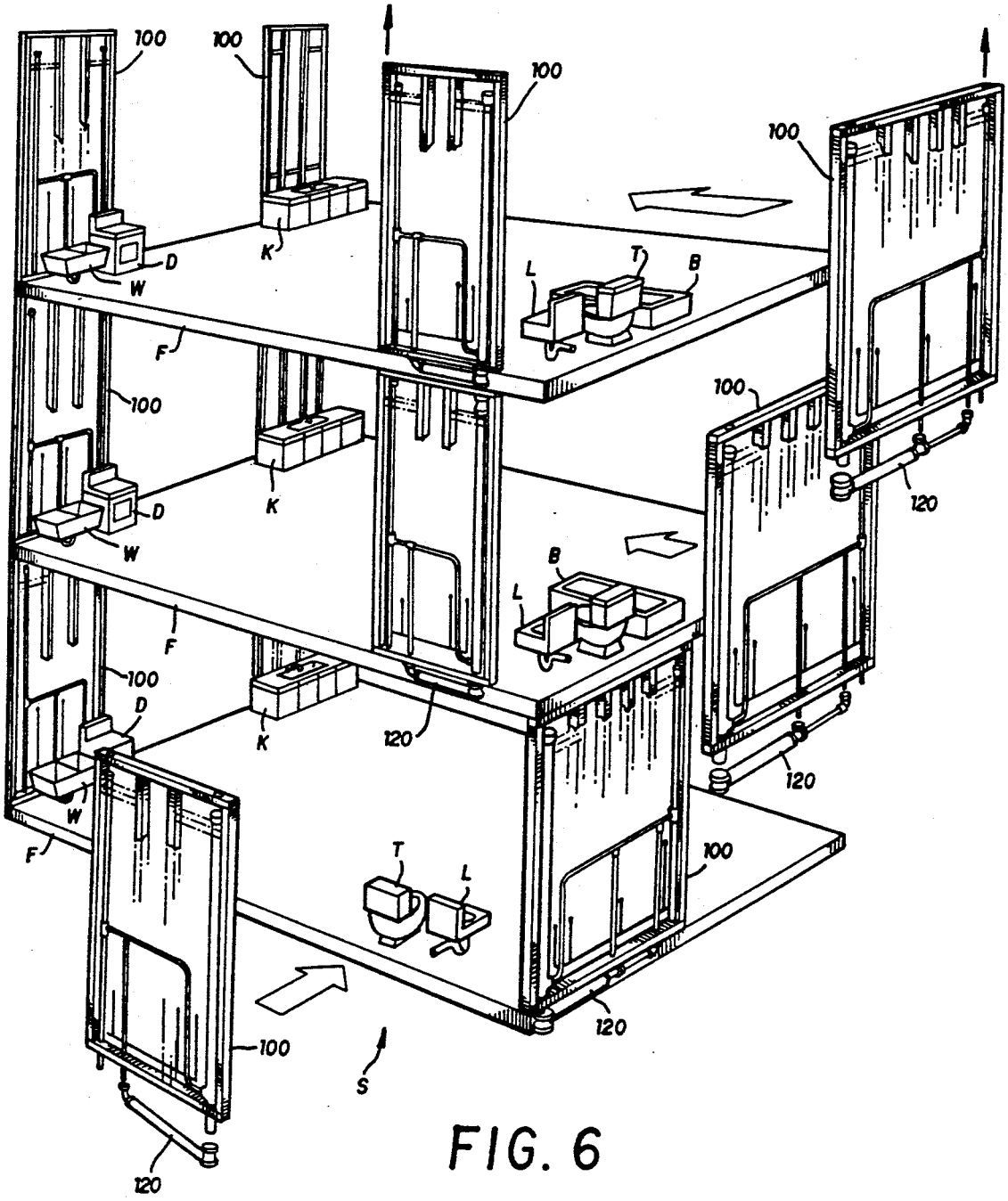
FIG. 6 is a partially exploded perspective view of a multistory building incorporating therein the first embodiment of the present invention.

The method of installing the framed wall sections 100 and the drain lines 120 of the first embodiment will now be described with reference to the partially exploded perspective view of FIG. 6.

After floors F of a multistory building structure S are laid in place, a bottom prefabricated drain line 120 is fitted into place in a lowermost floor F and a framed wall section 100 is installed thereon. Next, another prefabricated drain line 120 is fitted in place between upper and lower levels of the second floor F and is followed by the placement of a second framed wall section 100 thereon. Then, the prefabricated drain lines 120 and framed wall sections 100 are installed one after the other all the way up to a top floor F of the multistory structure S. Finally, the bathtub B, toilet T, lavatory L, kitchen K, wash basin W, dryer D, etc., are coupled to the proper plumbing lines in either the framed wall section 100 or the drain line 120 on each floor F. Dishwashers may be included either separately or as a part of the kitchen sink unit K.

Figure 7:
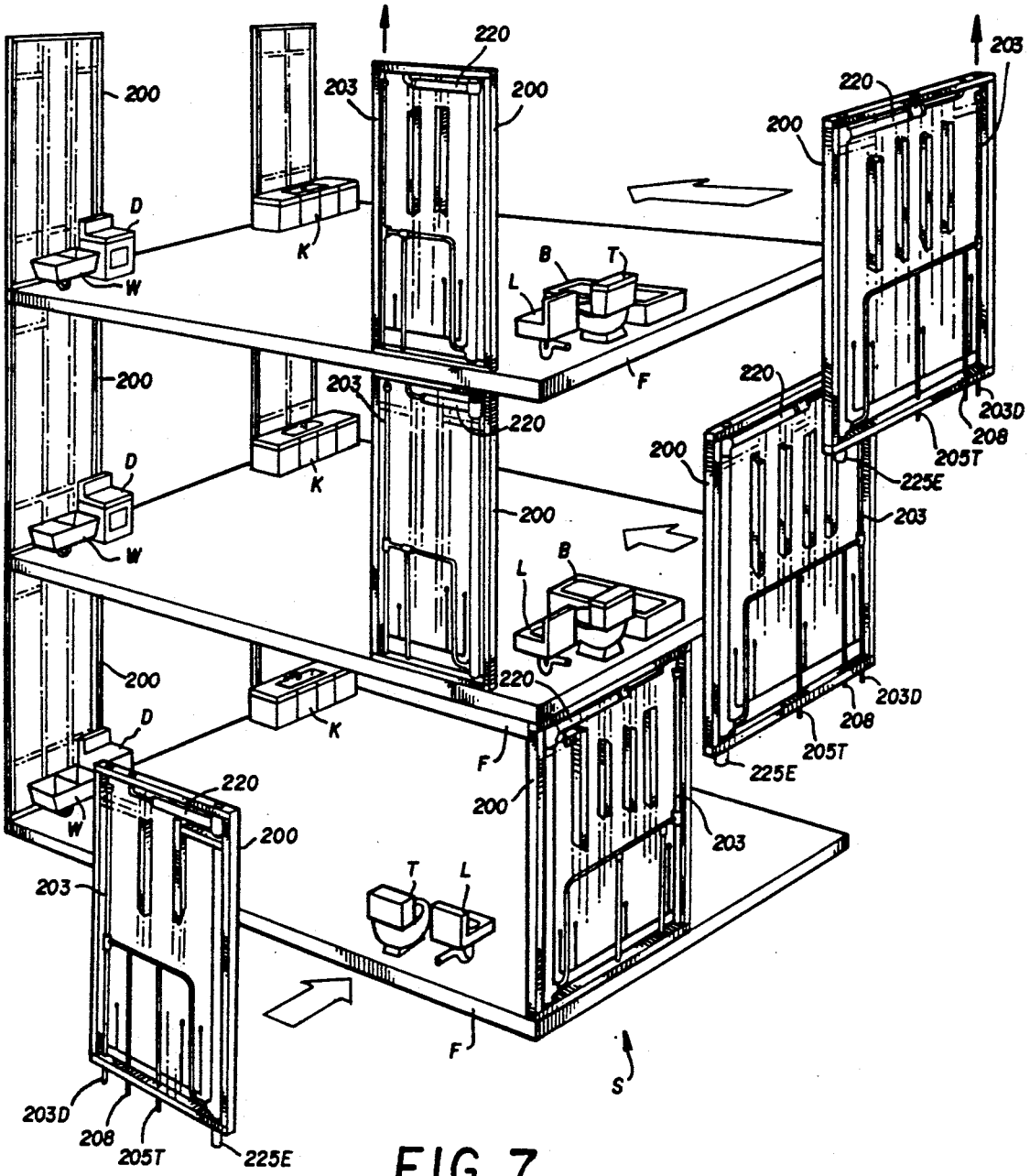
FIG. 7 is a partially exploded perspective view of a multistory building incorporating therein the second embodiment of the present invention.

In FIG. 7, the method of installing the framed wall sections 200 of the second embodiment is shown and can be seen to be substantially similar but not identical to the method of installing the framed wall sections 100 and the drain lines 120 of the first embodiment. For the sake of simplicity, the same letters used in FIG. 6 are likewise used in FIG. 7 to designate the same fixtures.

In the second method shown in FIG. 7, because the drain lines 220 are prefabricated directly into the framed wall sections 200, the first step is to drill holes through the lowermost floor F, if no openings have been provided for piping during construction, so that the depending end 203D of the vent stack 203, the bathtub sanitary tee 208, the toilet vent 205T, and the lower end 225E of the sewer pipe 225 may be placed in such holes. Then, an additional set of holes is drilled through the second floor F so that the same floor elements, i.e., end 203D, tee 208, vent 205T, and end 225E, of the next framed wall section 200 may be placed therein for connection with, respectively, the vent stack 203 and the underfloor drain line 220. As it may be seen by referring back to FIG. 4, the underfloor drain line 220 includes the upper end 220U, the inlet 210U, and the arm 220X for connection with, respectively, the tee 208, the vent 205T, and the end 225E. Returning now to FIG. 7, it should be apparent that the steps just enumerated above are repeated until holes are drilled in all floors F and wall sections 200 are installed therein all the way up to the top floor F. The fixtures are thereafter coupled to the proper plumbing lines.

The foregoing preferred embodiments are considered illustrative only. Numerous other modifications will readily occur to those persons skilled in the building industry. Consequently, the disclosed invention is not limited, but rather is defined by the claims appended hereto.

What I claim as my invention is the following:

1. A method of manufacturing a prefabricated framed wall to be mounted in a floor of a building structure under construction, said method comprising the steps of:

a. cutting at least one hole through all but one of a plurality of frame studs, a top frame plate, and a bottom frame plate;

b. aligning the plurality of frame studs to be oriented vertically and substantially parallel to each other;

c. securing tops of the plurality of frame studs to the top frame plate to be oriented horizontally;

d. securing bottoms of the plurality of frame studs to the bottom frame plate to be oriented substantially parallel to the top frame plate;

e. installing plumbing pipes between the plurality of frame studs, the top frame plate, and the bottom frame;

f. inserting an underfloor drain line below the bottom frame plate so that the drain line depends therebelow for connection in the floor; and g. securing a removable box means for protecting the drain line on an underside of the bottom frame plate so that the framed wall is ready to be shipped without damage to the drain line depending below the bottom frame plate.

2. The method according to claim 1, further comprising the step of:

h. installing at least one duct means for heating and/or cooling air between the plurality of frame studs, the top frame plate, and the bottom frame plate.

3. The method according to claim 1, further comprising the step of:

h. installing at least one electrical conduit between the plurality of frame studs, the top frame plate, and the bottom frame plate.

4. A method of manufacturing a prefabricated framed wall to be mounted in a floor of a building structure under construction, said method comprising the steps of:

a. cutting at least one hole through all but one of a plurality of frame studs, a top frame plate, and a bottom frame plate;

b. aligning the plurality of frame studs to be oriented vertically and substantially parallel to each other;

c. securing tops of the plurality of frame studs to the top frame plate to be oriented horizontally;

d. securing bottoms of the plurality of frame studs to the bottom frame plate to be oriented substantially parallel to the top frame plate;

e. installing plumbing pipes between the plurality of frame studs, the top frame plate, and the bottom frame plate;

f. inserting a sanitary tee of at least one of the plumbing pipes through at least one hole cut in the bottom frame plate so that the sanitary tee depends therebelow for connection below a bathroom floor to one of a bathtub and a shower;

g. fitting an underfloor drain line in communication with at least one plumbing pipe near to but below the top frame plate; and h. securing a removable box means for protecting the sanitary tee on an underside of the bottom frame plate so that the framed wall is ready to be shipped without damage to the sanitary tee depending below the bottom frame plate.

5. The method according to claim 4, further comprising the step of:

i. installing at least one duct means for heating and/or cooling air between the plurality of frame studs, the top frame plate, and the bottom frame plate.

6. The method according to claim 4, further comprising the step of:

i. installing at least one electrical conduit between the plurality of frame studs, the top frame plate, and the bottom frame plate.

7. A prefabricated framed wall to be mounted in a floor of a building structure under construction, said framed wall comprising:

a. a plurality of frame studs having at least one hole cut through all but one thereof and being oriented vertically and substantially parallel to each other;

b. a top frame plate having at least one hole cut therethrough and being horizontally oriented, said top frame plate being secured to tops of the plurality of frame studs;

c. a bottom frame plate having at least one hole cut therethrough and being horizontally oriented parallel to the top frame plate, said bottom frame plate being secured to bottoms of the plurality of frame studs;

d. plumbing pipes installed between the plurality of frame studs, the top frame plate, and the bottom frame plate;

e. an underfloor drain line means, attached at both ends to the plumbing pipes, for depending below the bottom frame plate for connection in the floor; and f. removable protective box means, secured to an underside of the bottom frame plate, for allowing the framed wall to be shipped without damage.

8. The framed wall according to claim 7, further comprising:

g. at least one duct means for heating and/or cooling air, said duct means being installed between the plurality of frame studs, the top frame plate, and the bottom frame plate.

9. The framed wall according to claim 7, further comprising:

g. at least one electrical conduit installed between the plurality of frame studs, the top frame plate, and the bottom frame plate.

10. A prefabricated framed wall to be mounted in a floor of a building structure under construction, said framed wall comprising:

a. a plurality of frame studs having a least one hole cut through all but one thereof and being oriented vertically and substantially parallel to each other;

b. a top frame plate being horizontally oriented and secured to tops of the plurality of frame studs;

c. a bottom frame plate having at least one hole cut therethrough and being horizontally oriented parallel to the top frame plate, said bottom frame plate being secured to bottoms of the plurality of frame studs;

d. plumbing pipes installed between the plurality of frame studs, the top frame plate, and the bottom frame plate;

e. a sanitary tee means, attached at one end to the plumbing pipes and inserted through at least one hole cut in the bottom frame plate, for depending below the bottom frame plate for connection below a bathroom floor to one of a bathtub and a shower;

f. an underfloor drain line fitted in communication with at least one plumbing pipe near to but below the top frame plate; and g. removable protective box means, secured to an underside of the bottom frame plate, for allowing the framed wall to be shipped without damage to the sanitary tee means.

11. The framed wall according to claim 10, further comprising:

g. at least one duct means for heating and/or cooling air, said duct means being installed between the plurality of frame studs, the top frame plate, and the bottom frame plate.

12. The framed wall according to claim 10, further comprising:

g. at least one electrical conduit installed between the plurality of frame studs, the top frame plate, and the bottom frame plate.

* * * * *